US009203539B2

(12) United States Patent
Velusamy et al.

(10) Patent No.: US 9,203,539 B2
(45) Date of Patent: Dec. 1, 2015

(54) BROADCASTING CONTENT

(75) Inventors: Umashankar Velusamy, Tampa, FL (US); Paul T. Schultz, Colorado Springs, CO (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 842 days.

(21) Appl. No.: 12/961,852

(22) Filed: Dec. 7, 2010

(65) Prior Publication Data

US 2012/0142383 A1 Jun. 7, 2012

(51) Int. Cl.
*H04H 60/07* (2008.01)
*H04H 60/52* (2008.01)

(52) U.S. Cl.
CPC ..... *H04H 60/52* (2013.01); *H04H 60/07* (2013.01)

(58) Field of Classification Search
CPC ..... H04H 60/07; H04H 60/52
USPC ..... 455/3.01–3.06
See application file for complete search history.

(56) References Cited

U.S. PATENT DOCUMENTS 6,972,787 B1 * 12/2005 Allen et al. ..... 348/162
7,688,379 B2 3/2010 Forman et al.
8,244,179 B2 * 8/2012 Dua ..... 455/41.2
2002/0085762 A1 7/2002 Shniberg et al.
2003/0179405 A1 9/2003 Seto
2005/0130680 A1 6/2005 Northcutt
2005/0135788 A1 * 6/2005 Fujii et al. ..... 386/112
2005/0218215 A1 * 10/2005 Lauden ..... 235/380
2006/0242679 A1 * 10/2006 Hutchison et al. ..... 725/105
2008/0109729 A1 5/2008 Notea et al.
2008/0235353 A1 * 9/2008 Cheever et al. ..... 709/219
2008/0297409 A1 12/2008 Klassen et al.
2009/0022357 A1 1/2009 Katz
2009/0063048 A1 * 3/2009 Tsuji ..... 701/212
2009/0093776 A1 4/2009 Yue et al.
2009/0132519 A1 5/2009 Rathod et al.
2009/0133059 A1 5/2009 Gibbs et al.
2009/0228204 A1 9/2009 Zavoli et al.
2010/0107088 A1 * 4/2010 Hunt et al. ..... 715/752
2010/0182436 A1 * 7/2010 Boman et al. ..... 348/207.1
2010/0241755 A1 * 9/2010 Bassett et al. ..... 709/229
2010/0325194 A1 12/2010 Williamson et al.
2011/0013038 A1 1/2011 Kim et al.

* cited by examiner

*Primary Examiner* — Raymond Dean

(57) ABSTRACT

A system is configured to: receive information identifying a geographic location of a user device of the user; identify a first recording device based on the geographic location and preferences of the user; instruct the first recording device to record content associated with the user; receive the content from the first recording device in response to instructing the first recording device to record the content; identify a first list of followers of the user based on the preferences of the user; and broadcast the content to follower devices corresponding to the first list of followers.

20 Claims, 6 Drawing Sheets

BROADCASTING CONTENT

BACKGROUND

As wireless network data rates improve using third generation (3G), fourth generation (4G), and WiFi technologies, users are using wireless networks for more and more bandwidth-intensive applications. Delivery of video content is becoming more popular with applications provided via mobile communication devices, such as smart phones (e.g., the Motorola DROID, the iPhone, etc.). At the same time, sharing of information through social networks is also becoming increasingly popular. However, options remain limited with regards to what information may be shared and how the information may be shared.

DETAILED DESCRIPTION OF PREFERRED EMBODIMENTS

Figure 1:
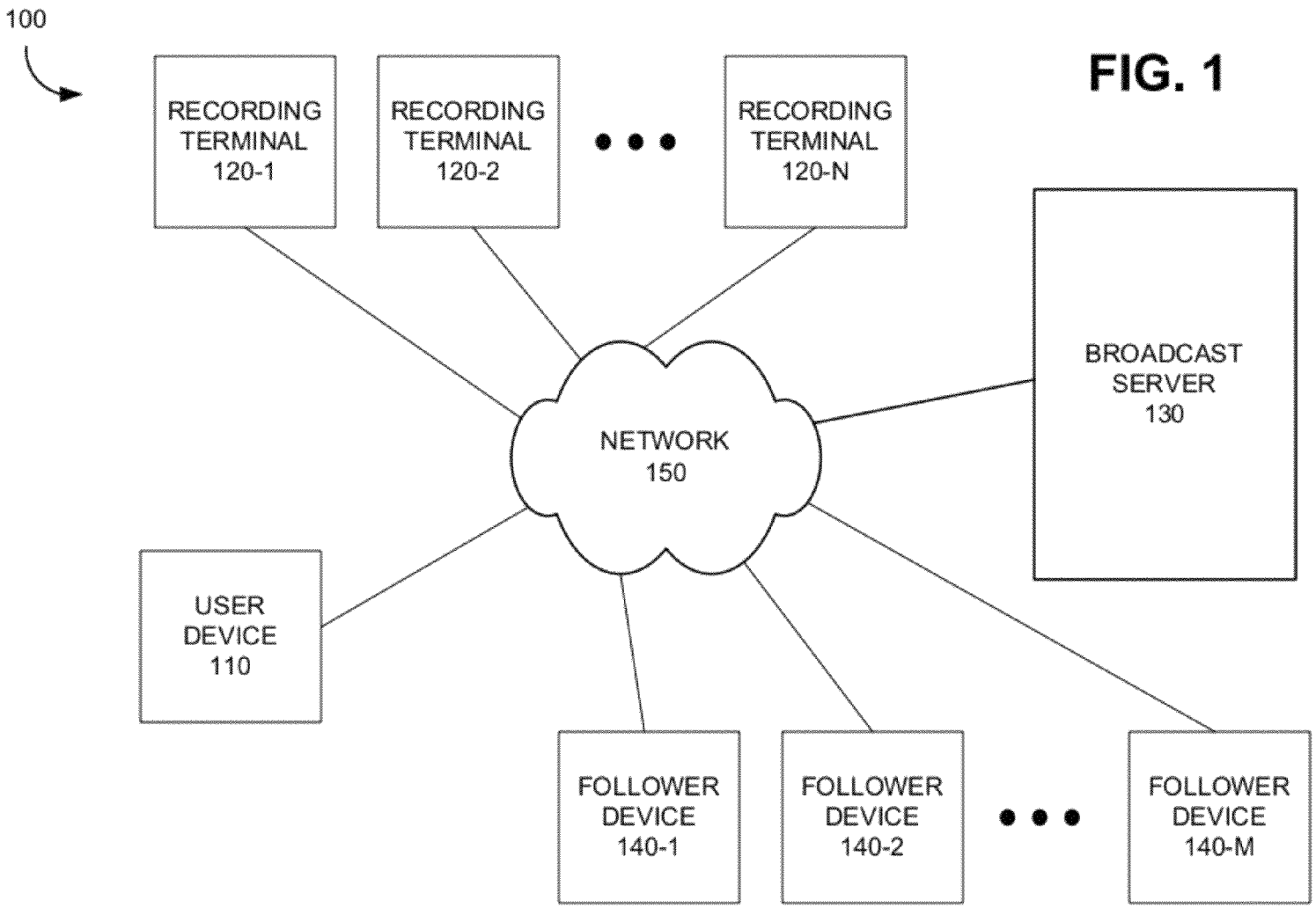
FIG. 1 is a diagram of an example environment in which systems and/or methods described herein may be implemented.

The following detailed description refers to the accompanying drawings. The same reference numbers in different drawings may identify the same or similar elements.

An implementation, described herein, may provide recording and broadcasting of content. The user may register for a service that may provide/manage broadcasts of content (e.g., video and audio content). The service may allow the user to select what recording devices (e.g., video cameras) may record when the user approaches the selected recording devices. The service may allow the user to create different lists for grouping potential followers (e.g., a user may create list 1 for co-workers, list 2 for family members, list 3 for friends, list 4 for restaurant lovers, etc.). The user may specify (i.e., set preferences regarding) which content (e.g., video recorded by camera 1, camera 5, or camera 12; video recorded after 3 p.m.; etc.) may be broadcast to which one or more lists of followers and how the content may be broadcast (e.g., pop-up a window to show a video on computer devices of the followers). The service may allow people to become followers of the user and/or join one or more of the lists. One of the selected recording devices may begin recording when the user approaches the selected recording device. The content being recorded by the selected recording device may be streamed to one or more followers of the user.

As used herein, the terms "user," "subscriber," "follower," and/or "viewer" may be used interchangeably. Also, the terms "user," "subscriber," "follower," and/or "viewer" are intended to be broadly interpreted to include a user device (e.g., a mobile communication device) or a user of a user device. The term "content" may refer to an image or video and/or audio content.

FIG. 1 is a diagram of an example environment 100 in which systems and/or methods described herein may be implemented. As illustrated, environment 100 may include one or more of the following components: a user device 110; recording terminals 120-1, 120-2, . . . , 120-N (N≥1) (referred to herein collectively as "recording terminals 110" or generically as "recording terminal 110"); a broadcast server 130; follower devices 140-1, 140-2, . . . , 140-M (M≥1) (referred to herein collectively as "follower devices 140" or generically as "follower device 140"); and a network 150. In practice, environment 100 may include additional components, fewer components, different components, or differently arranged components than are shown in FIG. 1. Also, components of environment 100 may interconnect via wired and/or wireless connections. In other words, any two components, of environment 100, may communicate via a wired connection, a wireless connection, or a combination of a wired connection and a wireless connection.

User device 110 may include any computation or communication device, such as a communication device that is capable of communicating (directly and/or via network 150) with recording terminals 120 and/or broadcast server 130. In one implementation, user device 110 may take the form of a smart phone, a personal digital assistant (PDA), a mobile telephone device, a laptop, a tablet, a television (TV), a handheld computer, a personal media player, etc. In another implementation, user device 110 may represent multiple devices operated by a user, including, for example, a personal computer and a mobile device. User device 110 may include one or more input components (e.g., a gyroscope, an accelerometer, a touch screen, a remote control device, a game controller, a keyboard, a keypad, a mouse, a microphone, etc.).

A user may use user device 110 to access a website provided by broadcast server 130. In another implementation, user device 110 may host an application that communicates with broadcast server 130. The user may use user device 110 to register for/subscribe to a broadcast (social-networking) service provided by broadcast server 130. In one implementation, recording terminal 120 or user device 110 may determine a location of user device 110. User device 110 may transmit the location to broadcast server 130. In another implementation, recording terminal 120 may be notified that user device 110 is in close proximity via geographic notification. Geographic notification may allow for recording terminal 120 to be notified when user device 110 enters or leaves a specified geographic fence. The geographic fence may be based on a location (e.g., a geographic point (latitude & longitude)) of recording terminal 120 and a specified radius. In yet another implementation, user device 110 may include or represent an identifier (e.g., token, RFID tag, barcode, unique directory address, electronic serial number, international mobile equipment identifier, machine access control address, mobile directory number, mobile equipment identity, mobile identification numbers, device ID, OpenID, MAC address, etc.) corresponding to the user. Recording terminal 120 may determine an identity of the user of user device 110 based on the identifier. Alternatively, user device 110 may determine its presence in a coverage area corresponding to recording terminal 120 based on pre-loaded maps and information that indicates positions of recording terminals 120. User device 110 may establish communication with recording terminal 120 corresponding to the coverage area.

User device 110 may receive various notifications/information regarding recording terminals 120 located near (within a predefined distance of) user device 110; content associated with a user of user device 110 that is being recorded and/or broadcasted; followers of the user; etc. from broadcast server 130. User device 110 may transmit selections made by the user (by using one or more of the aforementioned input components of user device 110 and/or one or more user interfaces displayed by user device 110) regarding recording terminals 120, the content being recorded and/or broadcasted, and/or the followers of the user to broadcast server 130. The user may use user device 110 to view, select, and/or edit content received from broadcast server 130 and/or other sources (not shown in FIG. 1) (e.g., YouTube). User device 110 may transmit the content and/or instructions for broadcasting the content to broadcast server 130. User device 110 may also act as follower device 140. In another implementation, user device 110 may receive content directly from recording terminals 120 in the vicinity of user device (e.g., via Wi-Fi, Bluetooth etc.). Recording terminals 120 may provide the content to user device 110 after authentication of user device 110 by broadcast server 130 and/or a secure link is established by broadcast server 130.

Recording terminal 120 may include any device that is capable of recording/capturing content and communicating with broadcast server 130. In a particular geographic area, there may be a single recording terminal 120 or multiple recording terminals 120 that may cover the particular geographic area. Recording terminal 120 may include one or more recording devices (e.g., a camera, a video camera, etc.) and one or more input devices for detecting a user and/or user device 110, as further described below with reference to FIG. 2. For example, recording terminal 120 may determine that a user is within an area of recording terminal 120 (i.e., the user is within a range that may allow recording terminal 120 to record content involving the user). Recording terminal 120 may record content involving the user. Recording terminal 120 may receive instructions/commands related to the recording of the content (directly or indirectly) from user device 110 and/or broadcast server 130. Recording terminal 120 may adjust the recording of the content based on the instructions/commands. Recording terminal 120 may stream the content to broadcast server 130 via network 150. In another implementation, user device 110 may act as recording terminal 120 or a part of recording terminal 120. For example, user device 110 may receive audio for content and recording terminal 120 may receive video for the same content.

Broadcast server 130 may include any computation or communication device, such as a communication device that is capable of communicating (directly or via network 150) with user device 110, recording terminals 120, and/or follower devices 140. Broadcast server 130 may represent a single server device or a collection of multiple server devices and/or computer systems. Broadcast server 130 may allow a user of user device 110 to register for a broadcast service provided by broadcast server 130. Broadcast server 130 may receive requests from follower devices 140 to follow the user (i.e., receive broadcasts/content of the user). Broadcast server 130 may determine a geographic location of user device 110 by, for example, receiving the location from user device 110 or from one or more networks connected to user device 110. Broadcast server 130 may determine one or more recording terminals 120—that may record content involving the user at the geographic location. Broadcast server 130 may transmit information about the upcoming broadcast of the content to user device 110 and/or follower devices 140. Broadcast server 130 may receive instructions regarding the recording (e.g., choice of a camera, how to position a camera, etc.) and/or the upcoming broadcast (e.g., choice of one or more lists of followers to whom the content should be transmitted) from user device 110 and/or follower devices 140. Broadcast server 130 may transmit recording instructions to one or more of recording terminals 120. Broadcast server 130 may receive content from recording terminals 120. Broadcast server 130 may allow the user of user device 110 to edit the content. Broadcast server 130 may broadcast/transmit the content to follower devices 140.

Follower device 140 may include any computation or communication device, such as a communication device that is capable of communicating with broadcast server 130 via network 150. In one implementation, follower device 140 may take the form of a smart phone, a PDA, a mobile telephone device, a personal computer, a laptop, a tablet, a TV, a handheld computer, a personal media player, etc. In another implementation, follower device 140 may represent multiple devices operated by a single follower. A follower may use follower device 140 to access a website provided by broadcast server 130. The follower may use follower device 140 to register for/subscribe to a broadcast (social-networking) service provided by broadcast server 130. Follower device 140 may transmit information regarding which user(s) the follower wants to follow (i.e., broadcast content of which user(s) the follower wants to receive), preferences regarding the broadcasts, etc. to broadcast server 130. Follower device 140 may receive content and instructions for displaying the content from broadcast server 130. Follower device 140 may display the content on a screen of follower device 140 based on the instructions for displaying the content. Follower device 140 may also act as user device 110.

Network 150 may include a single network, multiple networks of a same type, or multiple networks of different types. For example, network 150 may include one or more of a direct connection between devices, a local area network (LAN), a wide area network (WAN) (e.g., the Internet), a metropolitan area network (MAN), a wireless network (e.g., a general packet radio service (GPRS) network), a long term evolution (LTE) network), a telephone network (e.g., a Public Switched Telephone Network or a cellular network), a subset of the Internet, an ad hoc network, a fiber optic network (e.g., a fiber optic service (FiOS) network), or any combination of the aforementioned networks.

Figure 2:
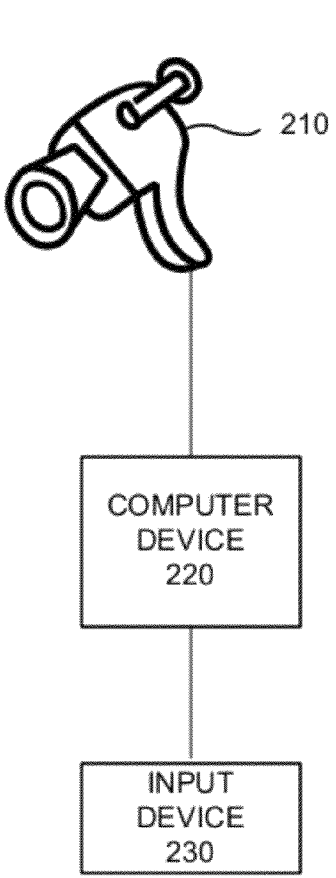
FIG. 2 is a diagram of example devices of a recording terminal of FIG. 1.

FIG. 2 is a diagram of example devices of recording terminal 120. Recording terminal 120 may include a recording device 210, a computer device 220, and an input device 230. In practice, recording terminal 120 may include additional devices, fewer devices, different devices, or differently arranged devices than are shown in FIG. 2. For example, recording terminal 120 may include multiple recording devices and/or multiple input devices. In a further example, multiple recording terminals 120 may be connected to one computer device 220. In another example, recording terminal 120 may not include a separate input device 230.

In some implementations, one or more of the devices of recording terminal 120 may perform one or more functions described as being performed by another one or more of the devices of recording terminal 120. Furthermore, two or more of the devices of recording terminal 120 may be implemented within a single device, or a single device may be implemented as multiple, distributed devices. For example, recording device 210, computer device 220, and/or input device 230 may be integrated into a single device that performs all or some of the functions described below as being performed by an individual one of these devices.

Devices of recording terminal 120 may interconnect via wired and/or wireless connections. In other words, any two devices, of recording terminal 120, may communicate via a wired connection, a wireless connection, or a combination of a wired connection and a wireless connection. In another implementation, two or more devices of recording terminal 120 may communicate via network 150.

Recording device 210 may include any device capable of recording/capturing content. Recording device 210 may represent multiple recording devices connected to computer device 220. Recording device 210 and computer device 220 may be part of a single device. Recording device 110 may take the form of a camera, a video camera, and/or an audio recorder. Recording device 210 may receive a command, from computer device 220, to begin recording. Recording device 210 may receive input video and/or audio content. Recording device 210 may adjust the input based on instructions (e.g., zoom in, zoom out, turn left, move up, etc.) received from computer device 220. Recording device 210 may generate content based on the input. Recording device 210 may transmit the generated content to computer device 220. Recording device 210 may receive a command to end the recording (i.e., the input) from computer device 220.

Computer device 220 may include any computation and/or communication device, such as a communication device that is capable of communicating with broadcast server 130 via network 150 and/or directly with recording device 210 and/or input device 230. For example, computer device 220 may take the form of a radiotelephone, a personal communications system (PCS) terminal (e.g., that may combine a cellular radiotelephone with data processing and data communications capabilities), a PDA (e.g., that can include a radiotelephone, a pager, Internet/intranet access, etc.), a wireless device, a smart phone, a laptop computer (e.g., with a wireless air card), a server, etc.

Computer device 220 may receive user identity information (e.g., identifier of user device 110, biometric information of a user, etc.) from input device 210. Computer device 220 may transmit the user identity information to broadcast server 130. Computer device 220 may receive command(s) and/or instruction(s) for recording content from broadcast server 130 and/or input device 210. In one implementation, computer device 220 may transmit the command(s) and/or the instruction(s) to recording device 210. In another implementation, computer device 220 may control recording device 210 based on the command(s) and/or the instruction(s) by, for example, transmitting signals to recording device 210. Computer device 220 may receive content from recording device 210. Computer device 220 may transmit/stream the content to broadcast server 130 via network 150.

Input device 230 may include any device capable of transmitting information from a user and/or user device 110 to computer device 220. Input device 230 may represent multiple input devices. Input device 230 and computer device 220 may be part of a single device. Input device 230 may receive one type of information or multiple types of information. Input device 230 may include one or more sensors to receive signals, such as wireless signals (e.g., infrared, Wi-Fi, LTE, and/or Bluetooth) or signals transmitted over wires (e.g., over a universal serial bus (USB) interface or the like) from user device 110 and/or computer device 220. Input device 230 may also include one or more biometric devices.

In one implementation, input device 230 may receive user identity information from user device 110 or another identifier (e.g., token, RFID tag, barcode, etc.) associated with a user. In another implementation, input device 230 may take the form of one or more biometric devices. A biometric device may include a device (e.g., a camera, a laser scanner, a microphone, etc.) that may receive biometric information associated with a particular user (e.g., a retina scan, a voice signature, a facial signature, a fingerprint, etc.). The biometric information may serve as user identity information for a user. Input device 230 may also receive user identity information (e.g., user name and password, user id and password, pass code (e.g., digital ID), user drawn pattern, etc.) and/or commands entered by a user using user device 110, directly or indirectly (e.g., via network 150 and/or broadcast server 130) from user device 110. Input device 230 may transmit the user identity information and/or commands to computer device 220.

Figure 3:
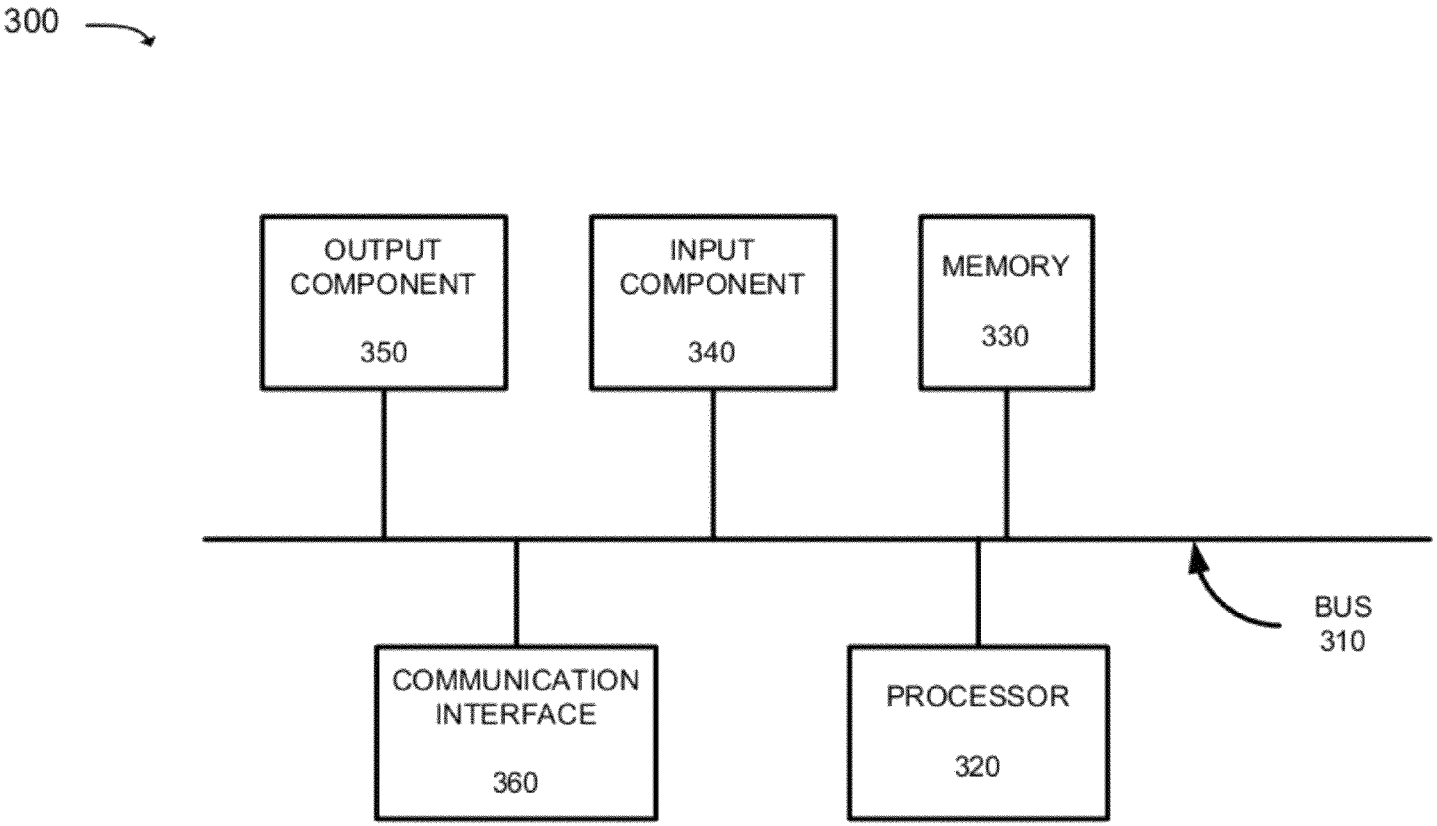
FIG. 3 is a diagram of example components of one or more of the devices of FIG. 1 and/or FIG. 2.

FIG. 3 is a diagram of example components of a device 300 that may be associated with user device 110, computer device 210, broadcast server 130, and/or follower device 140. Each of user device 110, computer device 210, broadcast server 130, and/or follower device 140 may include one or more devices 300 and/or one or more of each one of the components of device 300.

As shown in FIG. 3, device 300 may include a bus 310, a processor 320, a memory 330, an input component 340, an output component 350, and a communication interface 360. In another implementation, device 300 may include additional components, fewer components, different components, or differently arranged components than are shown in FIG. 3.

Bus 310 may include a path that permits communication among the components of device 300. Processor 320 may include a processor, microprocessor, or processing logic that may interpret and execute instructions. Memory 330 may include any type of dynamic storage device that may store information and instructions for execution by processor 320, and/or any type of non-volatile storage device that may store information for use by processor 320.

Input component 340 may include a mechanism that permits a user to input information to device 300, such as a keyboard, a keypad, a button, a switch, a camera, a microphone, etc. Output component 350 may include a mechanism that outputs information to the user, such as a display, a speaker, one or more light emitting diodes (LEDs), etc. Communication interface 360 may include any transceiver-like mechanism that enables device 300 to communicate with other devices and/or systems. For example, communication interface 360 may include an Ethernet interface, an optical interface, a coaxial interface, a wireless interface, or the like.

In another implementation, communication interface 360 may include, for example, a transmitter that may convert baseband signals from processor 320 to radio frequency (RF) signals and/or a receiver that may convert RF signals to baseband signals. Alternatively, communication interface 360 may include a transceiver to perform functions of both a transmitter and a receiver of wireless communications (e.g., radio frequency, infrared, visual optics, etc.), wired communications (e.g., conductive wire, twisted pair cable, coaxial cable, transmission line, fiber optic cable, waveguide, etc.), or a combination of wireless and wired communications. Communication interface 360 may connect to an antenna assembly (not shown in FIG. 3) for transmission and/or reception of the RF signals. The antenna assembly may include one or more antennas to transmit and/or receive RF signals over the air. The antenna assembly may, for example, receive RF signals from communication interface 360 and transmit them over the air, and receive RF signals over the air and provide them to communication interface 360. In one implementation, for example, communication interface 360 may communicate with network 150 and/or devices connected to network 150.

As will be described in detail below, device 300 may perform certain operations. Device 300 may perform these operations in response to processor 320 executing software instructions (e.g., computer program(s)) contained in a computer-readable medium, such as memory 330, a secondary storage device (e.g., hard disk, CD-ROM, etc.) or other forms of RAM or ROM. A computer-readable medium may be defined as a non-transitory memory device. A memory device may include memory space within a single physical memory device or spread across multiple physical memory devices. The software instructions may be read into memory 330 from another computer-readable medium or from another device. The software instructions contained in memory 330 may cause processor 320 to perform processes described herein. Alternatively, hardwired circuitry may be used in place of or in combination with software instructions to implement processes described herein. Thus, implementations described herein are not limited to any specific combination of hardware circuitry and software.

Figure 4:
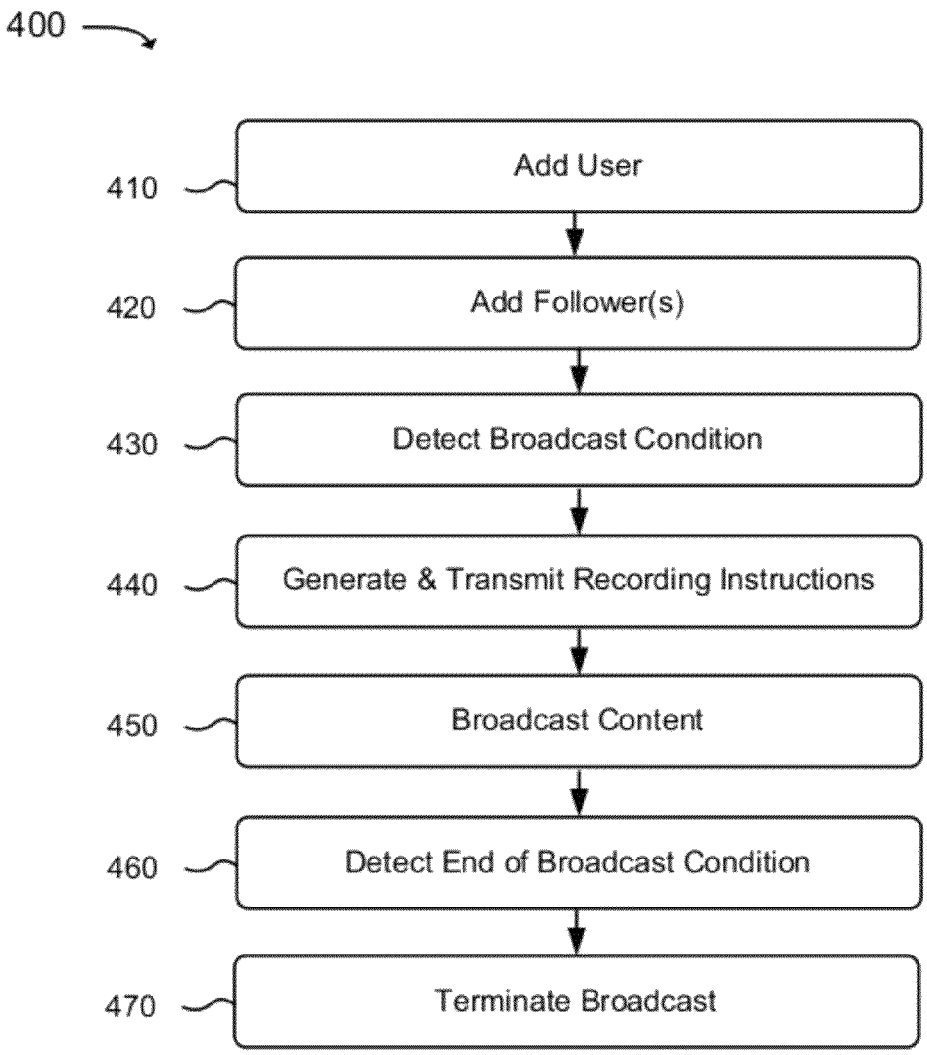
FIG. 4 is a flowchart of an example process for broadcasting content.

FIG. 4 is a flowchart of an example process 400 for broadcasting content. In one implementation, process 400 may be performed by broadcast server 130. In another implementation, some or all of process 400 may be performed by a device or collection of devices separate from, or in combination with, broadcast server 130.

As shown in FIG. 4, process 400 may include adding a user (block 410). For example, a user may decide to use a broadcast service provided by broadcast server 130. The user may use user device 110 to access a website provided by broadcast server 130. The user may enter user information (e.g., username, password, age, gender, address, etc.) and/or provide user identity information. The user identity information may include information that may be used to identify the user and/or user device 110 (e.g., mobile device of the user). The user identity information may include user device information of user device 110 (e.g., phone number corresponding to user device 110, RFID tag corresponding to user device 110, etc.) and/or biometric information of the user that may be used to identify the user. In one implementation, broadcast server 130 may provide an application to user device 110 and/or follower device 140 to allow a user and/or a follower to use the broadcast service on user device 110 and/or follower device 140.

Broadcast server 130 may provide one or more user interfaces to user device 130 for the user to select one or more recording terminals 120 and/or one or more recording devices 210 (herein, "recording terminals 120" may refer to recording devices 210) to record content involving the user when the user is within a range/an area of one of recording terminals 120. In one implementation, the user may select multiple recording terminals 120 corresponding to one or more geographic locations (represented by, for example, one or more of geographic coordinates, a geographic address, a name of a city, a description/name of a location etc. (e.g., Miami, Times Square in New York, White House, etc.)) and/or types of establishments (e.g., restaurants, fast food restaurants, office building, lobby, outdoor park, etc.). In another implementation, the user may select individual recording terminals 120 (e.g., the user may select camera 1, camera 547, camera 548, camera at the corner of $5^{th}$ St. and Main St., etc.). The user may, in order to select recording terminals 120, view a map showing different recording terminals 120 and/or use a search tool. The user may also request for broadcast server 130 to provide a preview of a view from one or more recording terminals 120 (e.g., a still image of a view from a viewpoint of camera 1, a live feed being recorded by camera 1, etc.). The user may also select all available recording terminals 120 and/or exclude recording terminals 120 individually and/or by specifying geographic locations, types of establishments (e.g., bathrooms), etc. User device 110 may transmit the information, related to selection(s) of recording terminals 120, to broadcast server 130. User device 110 may also store the information about selected recording terminals 120. At a later point in time, user device 110 may use the stored information about selected recording terminals 120 to provide the user with information about recording terminals 120 near the user.

Broadcast server 130 may provide one or more user interfaces to user device 110 for the user to specify additional recording preferences and/or broadcasting preferences. For example, the user may specify time different periods (e.g., September-November, 10:00 am-5:00 pm, Weekend, etc.) when content should be recorded by different recording terminals 120. The user may also specify how content should be recorded by specifying video quality, length of content, when to stop and start recording, required proximity of the user to the recording terminals 120, etc. The user may further instruct broadcast server 130 to transmit a notification to user device 110 and/or to receive a selection of a recording device (e.g., camera) from user device 110 before beginning recording of content. The user may also specify how content should be broadcast (e.g., pop-up a window on a screen of follower device 140 to display the content, receive permission to transmit the content to follower device 140 from follower device 140, store the content to be transmitted and/or accessed at a later point in time, etc.) and/or to whom different content should be broadcast. The user may also provide preferences related to who may access content that is saved by broadcast server 130, how the content may be accessed, and/or when (e.g., for how long) the content may be accessed. In other implementations, broadcast server 130 may allow a user to specify one or more of the preferences described above only after a person signs-up to be a follower of the user, as discussed further below. Broadcast server 130 may determine whether the follower has provided permission to allow the user to specify a preference (e.g., pop-up a window on a screen of follower device 140) in relation to the follower.

Broadcast server 130 may provide one or more user interfaces to user device 130 for the user to create lists for different groups of followers and/or to specify different criteria for a person to become a follower and/or join one of the lists. The user may also specify what type of content each one of the lists should receive. For example, the user may create list 1 for followers who are co-workers of the user, list 2 for followers who are family members of the user, and list 3 for followers who are friends of the user. The user may specify that only people who identify the same employer as the user, in their profiles (e.g., of a social network) and/or as user information, may become followers and join list 1. The user may further specify that followers who are grouped in list 1 may receive content recorded by, for example, recording terminals 120 in conference rooms of office buildings in Atlanta between 10:00 a.m.-5:00 p.m. on Monday-Friday. The user may also specify that broadcast server 130 may need to receive confirmation from user device 110 and/or follower device 140 before transmitting the content to the followers included (i.e., to follower device 140) in list 1.

For list 2, the user may specify that only people who have the same last name as the user may join list 2 as followers; that followers in list 2 may only receive content recorded by recording terminal 120-1 (e.g., camera 1) and recording terminal 120-9 (e.g., camera 9) between 6:00-10:00 p.m.; that the content provided to follower devices 140 should not exceed 15 seconds at one time; and that a window should pop-up to display the content on follower devices 140 when follower devices 140 receive the content from broadcast server 130. For list 3, the user may specify that only people expressly invited to join list 3 may join list 3 as followers. The user may use user device 110 to provide/enter names/identifiers of people who may join list 3 as followers. In another implementation, the user may use contacts in one or more existing contact lists or social network(s) to select people who may join list 3 as followers. The user may further specify that the followers of list 3 may receive content recorded by recording terminals 120 located outside of Georgia; that the content may be broadcast to follower device 140 only when broadcast server 130 receives a request for the content from follower device 140; and/or that broadcast server 130 may need to notify user device 110 regarding what follower devices 140 receive the content.

User device 110 may transmit the user information, the user identity information, the selections of recording terminals 120, the recording preferences, the broadcasting preferences, and/or information related to the created lists to broadcasting server 130. Broadcast server 130 may store the aforementioned information/preferences as part of a profile for the user in an internal and/or external storage device. Broadcast server 130 may add the user as a user of the broadcasting service by creating/storing the profile of the user. The user may use user device 110 to access a website provided by broadcast server 130 to modify information saved in the profile of the user (e.g., select new recording terminals 120, delete a list, set new preferences, etc.).

As further shown in FIG. 4, follower(s) may be added (block 420). For example, a follower may use follower device 140 and/or another computing device to access a website provided by broadcast server 130. The follower may be required to enter follower information (e.g., user identifier, username, name, address, etc.) and/or device information (e.g., contact information of follower device 140, type (e.g., Blackberry Tour, Apple iPad) of follower device 140, etc.) to be added as a follower of one or more users. In another implementation, broadcast server 130 may determine device type and device capabilities of follower device 140. The follower information and/or device information may be transmitted to broadcast server 130. In one implementation, broadcast server 130 may identify the follower based on the follower information when a user previously provided information to identify the follower in order to allow the follower to become a follower of the user and/or to allow the follower to join one or more lists created by the user. In another implementation, broadcast server 130 may provide one or more user interfaces for the follower to search for different users who are broadcasting content by using the broadcasting service. The follower may select which one or more users to follow and/or what list(s) corresponding to each user to join. Broadcast server 130 may determine whether the follower is allowed to follow the users (e.g., a user might require an invitation from the user to a person for the person to become a follower of the user) and join the list(s). In yet another implementation, broadcast server 130 may transmit an add request to user device 110 in order to request a user to provide permission to add a person as a follower of a user of user device 110. Broadcast server 130 may add the follower to one or more lists of one or more users.

In other implementations, broadcast server 130 may provide one or more user interfaces for the follower to provide preferences for receiving content. Follower device 140 may display the user interfaces and receive input from the follower. For example, a follower may elect to receive only content, involving one or more users, recorded by one or more recording terminals 120 and/or one or more recording devices 210. The follower may specify to receive content recorded only in one or more different time periods and/or receive the recorded content at one or more specified times. Furthermore, the follower may specify how she wants to receive the recorded content (e.g., pop-up a window on a screen of follower device 140 to display the content while the content is being recorded; notify the follower about the content being recorded via email, text message, and/or alert in a dedicated (broadcast service) application and allow the follower to select a recording device 210 to continue recording the content; allow the follower to retrieve the recorded content after the content is recorded; etc.). The follower may provide different preferences for different users that the follower is following and/or for different lists that the follower has joined.

Follower device 140 may transmit the preferences to broadcast server 130. Broadcast server 130 may determine whether the preferences are allowed for a follower of a user and/or a follower in a list (i.e., whether the preferences specified by the follower conflict with preferences specified by a user). Broadcast server 130 may notify the follower to modify preferences when the preferences set by the follower are not allowed. After the follower provides preferences that are allowed, the follower may be added as a follower of one or more users and/or included in one or more lists of the one or more users.

In another implementation, the user and/or the follower may be offered to use the broadcast service while browsing another social networking website. A registration process for the broadcast service may be integrated into the social networking website (e.g., the user may invite followers (for a list) from existing contacts in the social network). A member of the social network may only need to provide additional information necessary to be a user of the broadcast service, and not already stored by the social network for the member. Multiple social networks may provide access to the broadcast service for the same user(s) and/or followers. A single user/follower may broadcast, receive, and/or view content via the broadcast service by using one or more social networks.

As also shown in FIG. 4, a broadcast condition may be detected (block 430). For example, as discussed above, a user may specify one or more broadcast conditions. A broadcast condition may indicate when content associated with the user may be recorded and/or broadcasted to followers of the user. For example, a user may specify that a broadcast condition may be met/occur when the user is within a geographic area associated with recording terminal 120-3. The user, with user device 110, may walk into the area. In one implementation, user device 110 may transmit information identifying a location (e.g., geographic coordinates) of user device 110 to broadcast server 130. In other implementations, broadcast server 130 may provide an application to user device 110 for a broadcasting service. The application may transmit to broadcast server 130 a geographic notification when user device 110 is within a predefined distance/radius of one of recording terminals 120. Broadcast server 130 may determine (e.g., after receiving information identifying the location of user device 110 or the geographic notification) that the broadcast condition is met for the user because user device 110 is within the geographic area of recording terminal 120-3 (i.e., the location of user device 110 is within the geographic area). In another implementation, input device 230 of recording terminal 120-3 may receive user identity information in a form of an identifier of user device 110, biometric information (e.g., a facial image/signature) of a user, and/or information entered by the user. Computer device 220 of recording terminal 120-3 may transmit the user identity information to broadcast server 130. Broadcast server 130 may determine that the broadcast condition is met for the user because the user identity information corresponds to the user and the user is within the geographic area of recording terminal 120-3. In other implementations, the user may set additional broadcast conditions (including, for example, a broadcast condition that may be met when broadcast server 130 receives a broadcast command and/or content from user device 110, etc.).

Recording instructions may be generated and transmitted (block 440). In one implementation, after detecting that a broadcast condition is met for a user, broadcast server 130 may generate recording instructions based on recording preferences and/or broadcasting preferences (and/or recording instructions/commands provided by the user, as further described below). For example, the recording instructions may indicate which one or more recording devices 210 of recording terminal 120-3 should record content involving the user or provide information about how to determine one or more recording devices 210 of recording terminal 120-3 that should record the content (e.g., choose a camera by using facial recognition to determine what camera(s) have the best view of the user based on a facial signature of the user). The recording instructions may also include other information about how the content should be recorded (e.g., period of time for the recording, position of recording device 210, etc.) and/or transmitted to broadcast server 130 (e.g., stream the content to broadcast server 130 during the recording, etc.). Broadcast server 130 may transmit the recording instructions to computer device 220 of recording terminal 120-3.

In another implementation, after detecting that a broadcast condition is met, broadcast server 130 may transmit a notification that the broadcast condition is met to user device 110. For example, the notification may include information about a broadcast condition that is met; information about recording terminal 120-3; information about recording devices 210 of recording terminal 120-3 that are available to record a user (including, for example, locations and previews of views from the different recording devices (e.g., via a live feed, a still image, etc. from recording device 210)); information about follower(s) that may receive content recorded by recording terminal 120-3; etc. A user may use user device 110 to provide recording instructions (e.g., selection of one or more recording devices 210, position and degree of zoom of the one or more recording devices 210, length of content to be recorded, followers and/or lists that should receive the content, etc.). User device 110 may transmit the recording instructions directly to recording terminal 120-3 and/or via broadcast server 130.

Content may be broadcasted (block 450). For example, broadcast server 130 may receive content, involving a user, from recording terminal 120. Broadcast server 130 may identify which followers, of the user, should receive the content. Broadcast server 130 may continuously receive the content from recording terminal 120. In one implementation, broadcast server 130 may continuously stream the content to follower devices 140 of the identified followers and/or user device 110 of the user after receiving the content. In another implementation, before streaming the content to follower devices 140 of the identified followers, broadcast server 130 may transmit an image of the user and/or clip of the content to follower devices 140 of the identified followers. Follower device 140 may receive the image and/or clip of the content with a request to provide permission to stream the content of the user to follower device 140. A follower, of follower device 140, may use follower device 140 to provide permission for broadcast server 130 to stream/transmit the content to follower device 140 at a present time or at a later point in time. One or more of follower devices 140 may transmit permissions to receive the content to broadcast server 130. Broadcast server 130 may stream/transmit content to follower devices 140 that provided permissions for broadcast server 130 to stream/transmit the content based on the permissions. Follower devices 140 may receive the content along with instructions for displaying the content based on preferences set by the user and/or the follower(s). For example, the instructions may specify to pop-up a window on a screen of follower device 140 to display the content.

In another implementation, a user of user device 110 may allow only part of content recorded by recording terminals 120 to be broadcasted. The user may also use user device 110 device as a recording terminals 120 to record audio and/or video content. The user may allow to continuously broadcast one type of content from recording terminal 120 while adjusting what types of content, if any, may be broadcasted by other recording terminals 120. For example, the user may allow audio recorded by user device 110 to be broadcasted continuously (all the time), "mute" audio from all other recording terminals 120, and adjust, as the user moves around, what video recording devices of recording terminals 120 may record video involving the user. Broadcast server 130 may receive and aggregate audio and video content from different recording terminals 120. Broadcast server 130 may broadcast the aggregated content to follower devices 140.

Meanwhile, during the streaming of the content to follower devices 140, broadcast server 130 and/or input device 230 may receive a command from user device 110 and/or follower devices 140. For example, a user may use an input component of user device 110 to transmit command(s) to move recording device 210 while continuing to record the content. User device 110 may transmit the commands to broadcast server 130. Broadcast server 130 may generate new recording instructions based on the commands. Broadcast server 130 may transmit the new recording instructions to recording terminals 120.

During the broadcasting of the content, broadcast server 130 may transmit a broadcast message to user device 110 that describes which follower devices 140 are receiving the content and/or which followers are using follower devices 140 to view the content. The broadcast message may include a number representing how many follower devices 140 are receiving the content and/or identifiers of followers corresponding to follower devices 140. A user of user device 110 may provide privacy instructions to terminate broadcast of the content being transmitted (or to permanently end one or more broadcasts) to one or more follower devices 140. User device 110 may transmit the privacy instructions in a form of an exclusion message to broadcast server 130. The exclusion message may include identifiers of followers and/or follower devices 140 which the user does not want to receive the content. Broadcast server 130 may stop broadcasting the content to one or more follower devices 140 (and/or update one or more lists of the user) based on the exclusion message.

During the broadcasting of the content, broadcast server 130 may receive viewing instructions from follower devices 140. For example, a follower, associated with follower device 140-1, may follow multiple users. Broadcast server 130 may receive different content, involving the multiple users, from multiple recording terminals 120. Broadcast server 130 may transmit information about the different content to follower device 140-1. The follower may use follower device 140-1 to provide viewing instructions to broadcast server 130. For example, the viewing instructions may specify a request to view all of the content being received for the multiple users at the same time (e.g., in different windows), to view content corresponding to one of the users at a present time and to view the other content at a later point in time, to view the content individually and sequentially, etc. Broadcast server 130 may transmit the different content to follower device 140-1 based on the viewing instructions.

As also show in FIG. 4, an end of a broadcast condition may be detected (block 460). For example, content, involving a user, may be broadcasted after detecting a broadcast condition of the user being located within a geographic area of recording terminal 120-3. The user may leave the area. In one implementation, user device 110 may transmit an updated location of user device 110 to broadcast server 130. Broadcast server 130 may determine that user device 110 is no longer located within the geographic area of recording terminal 120-3. In a further implementation, input device 230 of recording terminal 120-3 may determine that the user is no longer located within the geographic area of recording terminal 120-3. Accordingly, recording terminal 120-3 may notify the broadcast server 130 that the user is no longer located within the geographic area of recording terminal 120-3. As a result, broadcast server 130 may determine an end of the broadcast condition that prompted the recording of the content by recording terminal 120-3 and the broadcasting of the content. In another implementation, the user may use user device 110 to transmit termination instructions to end recording of the content by recording terminal 120-3. Broadcast server 130 may detect an end of a broadcast condition based on the termination instructions. In yet another implementation, broadcast server 130 may detect the end of the broadcast condition after a predefined period of time defined as part of preferences of the user.

A broadcast may be terminated (block 470). After determining an end of a broadcast condition, broadcast server 130 may transmit instructions to recording terminal 120 for recording terminal 120 to stop recording content. Broadcast server 130 may further transmit information to user device 110 about the end of the broadcast condition. Broadcast server 130 may also transmit the rest of the content recorded by recording terminal 120 to follower devices 140 and a notification regarding the termination of the broadcast. Alternatively, broadcast server 130 may not transmit any more content even if broadcast server 130 has more content to send.

Figure 5:
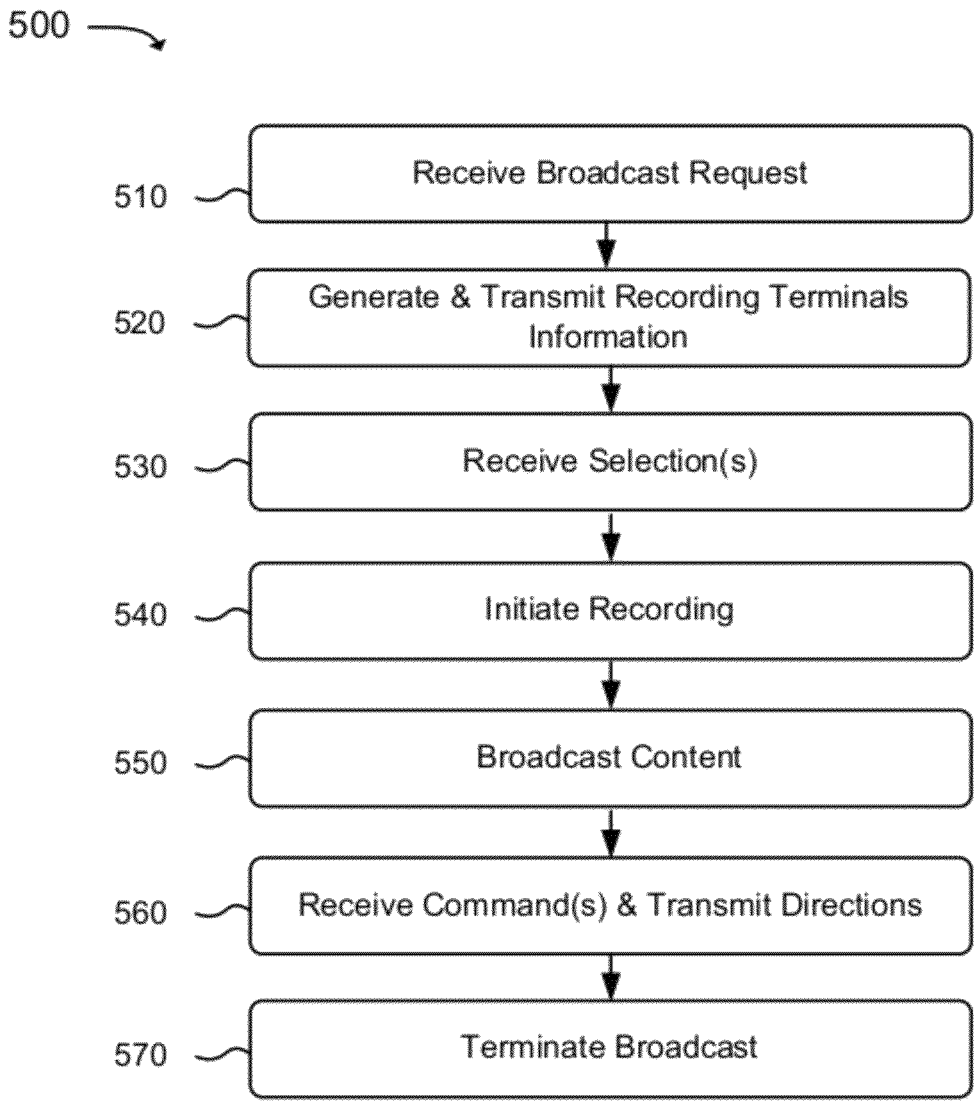
FIG. 5 is a flowchart of an example process for providing user-initiated broadcast of content.

FIG. 5 is a flowchart of an example process 500 for providing user-initiated broadcast of content. In one implementation, process 500 may be performed by broadcast server 130. In another implementation, some or all of process 500 may be performed by a device or collection of devices separate from, or in combination with, broadcast server 130.

As shown in FIG. 5, process 500 may include receiving a broadcast request (block 510). For example, a user may arrive at a geographic location. The user may use user device 110 to transmit a broadcast request to broadcast server 130. The broadcast request may include a request for information about recording terminals 120 near the geographic location. Broadcast server 130 may receive the broadcast request from user device 110.

Recording terminals information may be generated and transmitted (block 520). For example, broadcast server 130 may determine a geographic location of user device 110 based on a broadcast request received from user device 110. Thereafter, broadcast server 130 may identify recording terminals 120 that are located near the geographic location within a predefined distance and/or distances specified in the broadcast request. Broadcast server 130 may further narrow a list of identified recording terminals 120 based on preferences of a user of user device 110. Broadcast server 130 may generate recording terminals information to provide information about recording terminals 120 on the list.

In one implementation, the recording terminals information may include descriptions of locations (e.g., NW corner of the Stressed Salon, 2111 Franklin St., New York, N.Y.) of recording terminals 120 on the list and/or distances (e.g., 250 yards/meters) from recording terminals 120 on the list to the geographic location of user device 110. In another implementation, broadcast server 130 may generate a representation (e.g., a static map and/or an interactive map) that illustrates the locations of recording terminals 120 on the list in relation to the location of user device 110. For example, different symbols on the representation may represent the locations of recording terminals 120 and/or user device 110. A representation in a form of an interactive map may display the movement of user device 110 towards and/or away from the locations of recording terminals 120. The interactive map may also allow the user, of user device 110, to access additional information about each recording terminal 120 represented on the map. The additional information may include a name of an establishment housing recording terminal 120 (e.g., Bryant Park, Stressed Salon, etc.), a description of recording devices 210 corresponding to recording terminal 120, a preview of views of recording devices 210 corresponding to recording terminal 120, etc. Broadcast server 130 may transmit the recording terminals information to user device 110.

As further shown in FIG. 5, selections may be received (block 530). For example, user device 110 may receive recording terminals information in a form of an interactive map from broadcast server 130. A user, of user device 110, may proceed to move to an area corresponding to recording terminal 120 that is shown on the interactive map. The user may use user device 110 to select recording terminal 120 after arriving at the area. User device 110 may transmit the selection of recording terminal 120 to broadcast server 130. In another implementation, broadcast server 130 may determine recording devices 210 corresponding to recording terminal 120. Broadcast server 130 may transmit live feeds and/or still images corresponding to the recording devices 210 to user device 110. The user may use user device 110 to select recording devices 210 to record content involving the user. User device 110 may transmit the selection of recording devices 210 to broadcast server 130.

Recording may be initiated (block 540). For example, broadcast server 130 may receive selection(s) of one or more recording terminals 120 and/or recording devices 210 from user device 110. Broadcast server 130 may generate recording instructions for recording content involving the user based on the selection(s) and/or preferences of a user of user device 210. Broadcast server 130 may transmit the recording instructions to recording terminal 120. Computer device 220, of recording terminal 120, may receive the recording instructions. Computer device 220 may operate one or more recording devices 210 to record content based on the recording instructions.

Content may be broadcasted (block 550). For example, recording terminal 120 may transmit recorded content to broadcast server 130. Broadcast server 130 may determine which follower devices 140, corresponding to followers of a user, should receive the content. Broadcast server 130 may transmit information about the content being recorded to follower devices 140. Broadcast server 130 may receive different instructions from different follower devices 140 (e.g., provide the content to display now, provide the content at a later point in time, provide the content along with other content being received by broadcast server 130, etc.). Broadcast server 130 may transmit the content to follower devices 140 based on the instructions.

Commands may be received and directions may be transmitted (block 560). For example, broadcast server 130 may also transmit content received from recording terminal 120 to user device 110. A user, of user device 110, may use input components to provide commands regarding how recording terminal 120 should continue to record the content. The commands may include, for example, commands to use a different recording terminal 120 and/or recording device 210, commands to change the position of recording device(s) 210, commands to zoom-in and/or zoom-out, etc. In one implementation, user device 110 may transmit the commands to broadcast server 130. Broadcast server 130 may generate new recording instructions based on the commands. Broadcast server 130 may transmit the new recording instructions to recording terminal 120. Recording terminal 120 may adjust the recording of the content (e.g., rotate recording device 210, zoom-in, etc.) based on the new recording instructions. In another implementation, user device 110 may transmit the commands directly to input device 230 of recording terminal 120. Computer device 220, of recording terminal 120, may adjust the recording of the content based on the commands. In both implementations, recording terminal 120 may continue to transmit the recorded content to broadcast server 130.

A broadcast may be terminated (block 570). In one implementation, recording terminal 120 may determine that a user left a geographic area corresponding to recording terminal 120. For example, input device 220 of recording terminal 120 may continuously (or periodically) receive user identity information (e.g., a signal corresponding to an identifier of user device 110, biometric information of a user, etc.) during the recording and the broadcasting of content involving the user. Thereafter, recording terminal 120 may determine that input device 220 stopped receiving the user identity information. As a result, recording terminal 120 and/or broadcast server 130 may determine that the user left the geographic area corresponding to recording terminal 120. In response, recording terminal 120 may stop recording the content involving the user. Broadcast server 130 may send a message to user device 110 to indicate that the broadcast of the content recorded by recording terminal 120 was terminated because the user left the geographic area corresponding to recording terminal 120. The user may use user device 110 to transmit a new broadcast request to broadcast server 130 (block 510). The user may use user device 110 to provide new instructions/commands to record and/or broadcast new content not involving the user to broadcast server 130. For example, the user may provide commands for recording terminal 120 to continue recording new content even though the user might not be in an area corresponding to recording terminal 120 and for broadcasting server to receive and broadcast the new content.

In other implementations, a broadcast may be terminated by a user using user device 110 to provide directions for recording terminal 120 to stop recording content involving the user, by a broadcast server 130 transmitting instructions for recording terminal 120 to stop recording content after a predefined period based on preferences of the user, etc. Broadcast server 130 may terminate the broadcast after broadcast server 130 stops receiving newly recorded content for the broadcast from recording terminal 120.

A user may use a broadcasting service provided by broadcast server 130 to broadcast previously recorded content. For example, user device 110 may transmit previously recorded content (and/or an identifier corresponding to the previously recorded content) with broadcasting instructions to broadcast server 130. Broadcast server 130 may (retrieve the previously recorded content and) determine whether a broadcast of the previously recorded content is permitted (e.g., determine whether the previously recorded content is copyrighted, etc.). Broadcast server 130 may broadcast the previously recorded content based on the broadcasting instructions to one or more follower devices 140.

A user may also edit and/or tag content recorded by recording terminals 120. For example, broadcast server 130 may forward content from recording terminal 120 to user device 110 before broadcasting the content to follower devices 140. The user may use an application, provided by broadcast server 130 to user device 110, to modify the content (e.g., identify a celebrity by tagging an image of a celebrity included in the content; add descriptions of activities occurring in the content; etc.). User device 110 may transmit the modified content to broadcast server 130. Broadcast server 130 may broadcast the modified content to followers of the user by transmitting the modified content to follower devices 140. In another implementation, the content may also be automatically tagged (with, for example, a location of recording terminal 120), by broadcast server 130.

Figure 6:
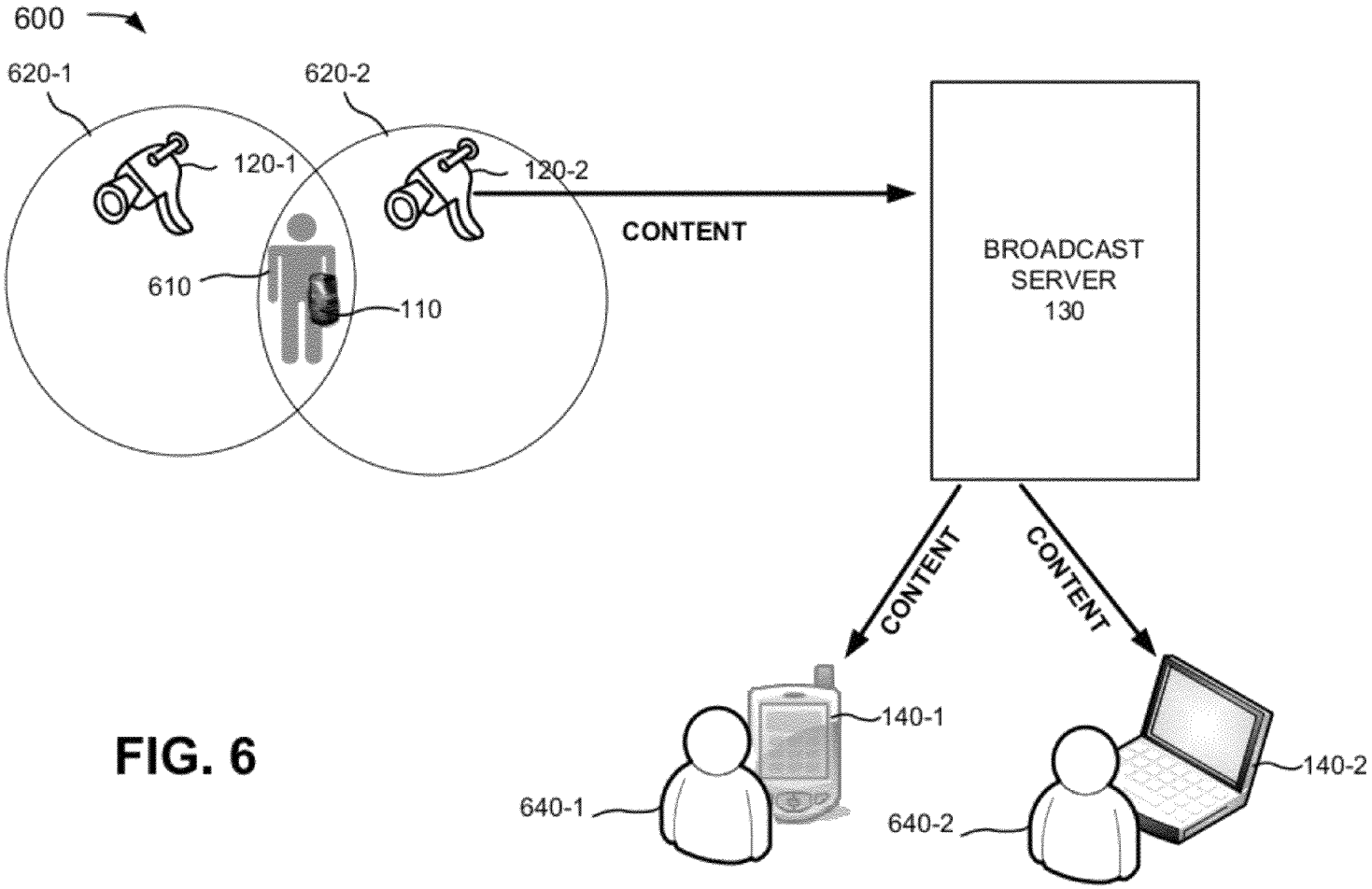
FIG. 6 is a diagram that illustrates an example of broadcasting content.

FIG. 6 is a diagram that illustrates an example 600 of broadcasting content. A user 610 may use user device 110 or another computing device to register for a broadcasting service, provided by broadcast server 130, in order to broadcast content to followers. A follower 640-1 may use follower device 140-1 and a follower 640-2 may use follower device 140-2 to sign-up as followers of the user, with respect to the broadcasting service, in order to receive content of user 610 from broadcast server 130. Follower 640-1 may provide complete permission for user 610 to control how and/or when content of user 610 is received by follower device 140-1. User 610 may set preferences for a window to pop-up, on a screen of follower device 140-1, to display the content as soon as follower device 140-1 receives the content. Follower 640-2 may provide limited permissions for user 610 to determine how and/or when content of user 610 is received by follower device 140-2. For example, follower 640-2 may restrict the content of user 610 from being transmitted to follower device 140-2 until follower 640-2 retrieves the content from broadcast server 130 and/or follower 640-2 provides explicit permission to receive the content. Each one of follower 640-1 and follower 640-2 may also register as a user in order to broadcast content via the broadcasting service. User 610 may sign-up as a follower of follower 640-1 and/or follower 640-2.

Assume that user 610 proceeds to move to a location (e.g., a middle of a restaurant) that is in an area 620-1 and an area 620-2 at 1:00 p.m. on Friday. Area 620-1 may correspond to an area covered by recording terminal 120-1 (e.g., a camera). Recording terminal 120-1 may record (e.g., generate video and audio content based on) activity within area 620-1. Area 620-2 may correspond to an area covered by recording terminal 120-2 (e.g., a camera). Recording terminal 120-2 may record (e.g., generate video and audio content based on) activity within area 620-2.

In one implementation, user device 110 may transmit location information (e.g., geographical coordinates of the location) to broadcast server 130. Broadcast server 130 may determine that user 610 is in area 620-1 and area 620-2 based on the location information. Broadcast server 130 may identify recording terminal 120-1 for area 620-1 and recording terminal 120-2 for area 620-2. Broadcast server 130 may retrieve and create a first live feed for recording terminal 120-1 and a second live feed for recording terminal 120-2. Broadcast server 130 may transmit information about available recording terminals to user device 110. The information about available recording terminals may include a map showing a position of recording terminal 120-1 and a position of recording terminal 120-2 in relation to the location of user device 110. The information about available recording terminals may also include the first live feed and the second live feed. Assume user 610 selects, using user device 110, recording terminal

120-2 to record content involving user 610. User device 110 may transmit the selection to broadcast server 130. Broadcast server 130 may transmit recording instructions to recording terminal 120-2 in response to the selection and based on preferences of user 610.

In another implementation, recording terminal 120-1 may capture and transmit a first facial image of user 610 and/or recording terminal 120-2 may capture and transmit a second facial image of user 610. Broadcast server 130 may receive the first facial image and the second facial image of user 610. Broadcast server 130 may identify user 610 by comparing the first facial image and/or the second facial image to a facial signature saved for the user. Broadcast server 130 may also determine that, for example, recording terminal 120-2 may record better content involving user 610 by comparing the first facial image and the second facial image to the facial signature and determining that the second facial image is a better match to the facial signature (when, for example, user 610 is closer to recording terminal 120-2 than recording terminal 120-1). As a result, broadcast server 130 may transmit recording instructions to recording terminal 120-2 in response to the determination and based on preferences of user 610.

Recording terminal 120-2 may receive the recording instructions from broadcast server 130, and record content based on the recording instructions. Recording terminal 120-2 may also receive commands (e.g., zoom-in), entered by user 610 using user device 110, directly from user device 110 and/or via broadcast server 130. Recording terminal 120-2 may modify the recording of the content based on the commands. Recording terminal 120-2 may transmit the recorded content to broadcast server 130. Broadcast server 130 may receive the content.

Broadcast server 130 may proceed to identify followers of user 610 who may receive and/or access content recorded by recording terminal 120-2 in the middle of the restaurant at 1:00 p.m. on Friday. Broadcast server 130 may identify follower 640-1 and follower 640-2. Broadcast server 130 may transmit the content and display instructions (e.g., pop-up a window to display the content) to follower device 140-1 based on preferences of user 610 and preferences of follower 640-1. Follower device 140-1 may receive the content, pop-up the window to display the content, and signal (e.g., vibrate, ring, etc.) that the content is received. Follower 640-1 may view the content on the screen of follower device 140-1. Follower 640-2 may use follower device 140-2 to determine whether new content has been received by broadcast server 130 for user 610. Follower 640-2 may use follower device 140-2 to retrieve the content from broadcast server 130 by transmitting a request to broadcast server 130. Follower device 140-2 may receive the content from broadcast server 130 in response to the request and display the content on a screen of follower device 140-2. Follower 640-2 may view the content on the screen of follower device 140-2.

Assume that user 610 moves to a new location outside of area 620-2. In one implementation, user device 110 may transmit information regarding the new location to broadcast server 130. Broadcast server 130 may determine that user 610 moved outside of area 620-2 and, accordingly, transmit an end recording instruction to recording terminal 120-2 to stop recording content for user 610. In another implementation, recording terminal 120-2 may determine that user 610 is no longer within area 620-2, via its own input device 230, and stop recording content for user 610. Broadcast server 130 may also send a notification to user device 110 to notify user 610 that recording terminal 120-2 stopped/will stop recording content involving user 610 because user 610 moved outside of area 620-2.

The foregoing description provides illustration and description, but is not intended to be exhaustive or to limit the invention to the precise form disclosed. Modifications and variations are possible in light of the above teachings or may be acquired from practice of the invention.

While series of blocks have been described with regard to FIGS. 4 and 5, the order of the blocks may be modified in other implementations. Further, non-dependent blocks may be performed in parallel.

It will be apparent that systems and methods, as described above, may be implemented in many different forms of software, firmware, and hardware in the implementations illustrated in the figures. The actual software code or specialized control hardware used to implement these systems and methods is not limiting of the implementations. Thus, the operation and behavior of the systems and methods were described without reference to the specific software code—it being understood that software and control hardware can be designed to implement the systems and methods based on the description herein.

Even though particular combinations of features are recited in the claims and/or disclosed in the specification, these combinations are not intended to limit the disclosure of the invention. In fact, many of these features may be combined in ways not specifically recited in the claims and/or disclosed in the specification. Although each dependent claim listed below may directly depend on only one other claim, the disclosure of the invention includes each dependent claim in combination with every other claim in the claim set.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A method comprising:

detecting, by a server device, one or more broadcast conditions associated with recording content associated with a user;

transmitting, by the server device, recording instructions to a first recording terminal based on detecting the one or more broadcast conditions;

receiving, by the server device, the content from the first recording terminal;

identifying, by the server device, a group of followers of the user to receive the content;

determining, by the server device, a first preference and a second preference associated with the content, the first preference indicating: whether a permission is to be received, from the group of followers, prior to transmitting the content to the group of followers, and the second preference indicating when the content is to be accessed; and providing, by the server device, the content to the group of followers based on the first preference and the second preference, providing the content including:

transmitting, by the server device and to the group of followers, information to request the permission based on the preference;

receiving, by the server device, the permission from the group of followers based on transmitting the information to request the permission; and transmitting, by the server device, the content to the group of followers based on receiving the permission.

2. The method of claim 1, where the detecting the one or more broadcast conditions comprises: receiving information identifying a location of a user device of the user; and detecting the one or more broadcast conditions when the location is within a geographic area associated with the first recording terminal.

3. The method of claim 1, where the detecting the one or more broadcast conditions comprises: receiving identity information from the first recording terminal; identifying the user based on the identity information, where the identity information comprises biometric information of the user and information identifying a user device associated with the user; and detecting the one or more broadcast conditions based on identifying the user.

4. The method of claim 1, further comprising:

transmitting a first option and a second option to a user device of the user, where the first option corresponds to recording the content using the first recording terminal, and where the second option corresponds to recording the content using a second recording terminal;

receiving a selection of the first option from the user device; and generating the recording instructions based on the selection.

5. The method of claim 1, further comprising:

receiving a first image of the user from the first recording terminal;

receiving a second image of the user from a second recording terminal;

determining whether to use the first recording terminal or the second recording terminal by comparing the first image and the second image to an image of the user; and selecting the first recording terminal based on comparing the first image and the second image to the image of the user.

6. The method of claim 1, further comprising:

receiving information identifying a geographic location of a user device of the user;

determining whether the geographic location is within an area corresponding to the first recording terminal; and transmitting an end recording instruction to the first recording terminal when the geographic location is outside the area.

7. The method of claim 1, further comprising:

receiving a command from the user;

generating a new recording instruction based on the command; and transmitting the new recording instruction to the first recording terminal, where the new recording instruction prompts the first recording terminal to at least one of:

move a camera of the first recording terminal, zoom-in on the user, or zoom-out on the user.

8. The method of claim 1, further comprising:

receiving audio content from a second recording terminal; and aggregating the content and the audio content into aggregated content; and where transmitting the content comprises:

transmitting the aggregated content to the group of followers.

9. A system comprising:

a memory to store information identifying preferences associated with a user, the preferences including:

information, specified by the user, indicating when content is to be accessed, and information, specified by the user, indicating whether a permission is to be received, from followers of the users, prior to providing the content to the followers; and a processor to:

receive information identifying a geographic location of a user device associated with the user, identify a first recording device based on the information identifying the geographic location and information identifying a proximity of the user to recording devices, instruct the first recording device to record particular content associated with the geographic location of the user device, receive the particular content from the first recording device based on instructing the first recording device to record the particular content, identify a first list of followers of the user based on the preferences, and provide the particular content to follower devices corresponding to the first list of followers based on the preferences.

10. The system of claim 9, where the processor is further to:

receive the information identifying the preferences from the user device, where the preferences comprise a recording preference, where the recording preference specifies:

the first recording device and a second recording device for recording the particular content, and an area corresponding to the first recording device, and where the geographic location of the user is within the area corresponding to the first recording device.

11. The system of claim 9, where the preferences comprise a broadcasting preference, and where the broadcasting preference specifies the first list of followers for receiving content recorded during a first time period and a second list of followers for receiving content recorded during a second time period, where the first time period is different from the second time period.

12. The system of claim 9, where the processor is further to:

receive a follower request for a follower to join the first list of followers;

determine whether the follower meets criteria, indicated by the preferences, for joining the first list of followers; and add the follower to the first list of followers when the follower meets the criteria.

13. The system of claim 9, where the processor is further to: generate a broadcast message, where the broadcast message identifies particular followers corresponding to the follower devices that are receiving the particular content; transmit the broadcast message to the user device; receive an exclusion message from the user device; and end transmitting the particular content to one or more of the follower devices based on the exclusion message.

14. The system of claim 9, where, when providing the particular content to the follower devices, the processor is to: transmit, to the follower devices, at least one of an image of the user or a clip of the particular content; receive a permission to transmit the particular content to one or more of the follower devices from the one or more of the follower devices; and transmit the particular content to the one or more of the follower devices based on the permission.

15. A non-transitory computer-readable media storing instructions, the instructions comprising:

one or more instructions that, when executed by a processor, cause the processor to:

receive a broadcast request from a user device, the broadcast request comprising:

information identifying a geographic location of the user device, and information, specified by a user of the user device, identifying a particular distance from the geographic location of the user device to recording terminals;

generate recording terminals information based on the geographic location and the information identifying the particular distance, the recording terminals information comprising information identifying a first recording terminal and a second recording terminal, each of the first recording terminal and the second recording terminal being located within the particular distance of the geographic location of the user device;

transmit the recording terminals information to the user device;

receive a selection of the first recording terminal from the user device;

transmit recording instructions to the first recording terminal based on the selection;

receive content from the first recording terminal based on transmitting the recording instructions to the first recording terminal;

determine preferences associated with providing the content, the preferences indicating:

when the content is to be accessed, and whether a permission is to be received, from one or more devices, prior to providing the content to the one or more devices; and provide the content to the one or more devices based on the preferences.

16. The non-transitory computer-readable media of claim 15, where the one or more instructions to generate the recording terminals information comprise:

one or more instructions that, when executed by the processor, cause the processor to:

identify a plurality of recording terminals within the particular distance of the geographic location; and generate the recording terminals information based on identifying the plurality of recording terminals.

17. The non-transitory computer-readable media of claim 15, where the recording terminals information comprises a representation showing a first symbol corresponding to the first recording terminal, a second symbol corresponding to the second recording terminal, and a third symbol corresponding to the user device, and where the third symbol corresponding to the user device moves in the representation when the user device moves to a different geographic location.

18. The non-transitory computer-readable media of claim 15, where the one or more instructions to provide the content comprise:

one or more instructions that, when executed by the processor, cause the processor to:

identify one or more followers of the user;

select the one or more followers to receive the content based on at least one of the preferences; and provide the content to the one or more devices based on selecting the one or more followers.

19. The non-transitory computer-readable media of claim 15, where the one or more instructions to provide the content comprise: one or more instructions that, when executed by the processor, cause the processor to: identify one or more followers of the user; transmit information identifying the one or more followers to the user device; receive a selection of the one or more followers from the user device; and broadcast the content to the one or more devices based on the selection of the one or more followers.

20. The non-transitory computer-readable media of claim 15, where the one or more instructions to provide the content comprise:

one or more instructions that, when executed by the processor, cause the processor to:

transmit, to the one or more devices, information to request the permission based on one of the preferences;

receive the permission from the one or more devices based on transmitting the information to request the permission; and provide the content to the one or more devices based on receiving the permission.

* * * * *